US005414884A

United States Patent [19]

Mackenzie

[11] Patent Number: 5,414,884

[45] Date of Patent: May 16, 1995

[54] SEAT CUSHION ASSEMBLY

[76] Inventor: Robert O. Mackenzie, 9 Deertree Dr., Rt. 14 Hwy. 20 W., Tallahassee, Fla. 32304

[21] Appl. No.: 269,146

[22] Filed: Jun. 30, 1994

[51] Int. Cl.[6] ..... A47C 7/02

[52] U.S. Cl. ..... 5/653; 5/468; 5/654; 297/452.23; 297/452.55; 297/284.1

[58] Field of Search ..... 5/464, 465, 468, 653, 5/654; 297/452.23, 452.55, 284.1

[56] References Cited

U.S. PATENT DOCUMENTS 3,885,257 5/1975 Rogers ..... 5/464
3,987,507 10/1976 Hall ..... 5/653
4,132,228 1/1979 Green .
4,682,818 7/1987 Morell ..... 5/653 X
4,753,480 6/1988 Morell ..... 5/653 X
5,048,137 9/1991 Rogers ..... 5/464

*Primary Examiner*—Michael F. Trettel
*Attorney, Agent, or Firm*—Carnes, Cona, Dixon

[57] ABSTRACT

A seat cushion assembly is provided that is specifically designed to alleviate the problems, such as discomfort, pressure sores, pressure ulcers, and hemorrhoids, that are associated with long term sedentary positions (i.e. patients in wheelchairs). The seat cushion assembly of the present invention includes a base having a pair of openings. Cushion inserts are located in the openings. The seat cushion assembly, when in use, provides an individual with an equal amount of pressure distribution in the gluteal region.

19 Claims, 1 Drawing Sheet

SEAT CUSHION ASSEMBLY

BACKGROUND OF THE INVENTION

This invention relates in general to a seat assembly, more particularly, this invention is directed to a seat assembly that is specifically designed to alleviate the problems, such as discomfort, pressure sores, pressure ulcers, and hemorrhoids, that are associated with long term sedentary positions (i.e. patients in wheelchairs).

For individuals who are required to sit for a long period of time, the bone structure in the pelvic area is the point for the exertion of a concentration of pressure. This concentration occurs on a small tissue/skin area that results in a high stress concentration in that particular area. This high stress concentration results in an obstruction of blood flow, thereby resulting in ischemia.

Adequate weight distribution in the gluteal region is needed in order to solve the problems that are associated with long term sitting. A device which does permit equal amount of pressure distribution in the gluteal region is disclosed in U.S. Pat. No. 4,132,228 issued to Green. This patent discloses a support seat cushion assembly having indentations for the ischial tuberosities and an opening for the coccyx. This seat is fabricated from a plurality of foam layers.

A problem with this seat is that the user is limited to the use of foam and eventually, with time, this seat will become distorted, non-effective, and non-functioning.

What is needed is a seat assembly that provides for an equal pressure distribution in the pelvic area. Such an assembly must permit the user to chose the type of cushion which is most appropriate and comfortable for their use. Ideally, this device should be long lasting and inexpensive to manufacture.

SUMMARY OF THE INVENTION

This invention provides for a seat cushion assembly that will deliver comfort for people who sit for a long period of time. Additionally, this seat cushion assembly has a unique configuration and structure in order to provide for an equal amount of pressure distribution in the gluteal region. The seat cushion assembly of the present invention consists of a base, a seating pad, and cushion inserts which are located at the areas for the pelvic area (i.e. ischial tuberosities) and coccyx.

The base of the present invention is fabricated from a sturdy material, such as plastic or wood, and is provided with a pair of openings. Cushion inserts are placed inside the openings for pressure relief of the ischial tuberosities. A third opening is located in the base. This third opening has a conical shape which permits a means to relieve pressure for the coccyx. A seating pad may be placed on the base.

The cushion inserts are attachable to and removable from the first and second openings. This will permit an individual to chose the type and model of cushion which is most appropriate and comfortable for their use.

Additionally, a height adjusting means may be provided on the lower surface of the base. This height adjusting means will provide for the seat cushion assembly to be raised to a desired elevation.

The unique configuration of the seat cushion assembly provides an individual with an easy means of cleaning and maintaining the seat and its components.

Therefore, it is the object of the present invention to provide for a seat cushion assembly that will alleviate discomfort, pressure sores, hemorrhoids, and fatigue of people that are required to sit for long terms.

It is another object of the present invention to provide for a seat cushion assembly that will consistently maintain tissue interface pressures below capillary closing pressure, thereby maintaining continuous blood flow to tissues.

It is another object of the present invention to provide for a seat cushion assembly that is applicable to any type chair.

It is another object of the present invention to provide for a seat cushion assembly that is individualized.

It is another object of the present invention to provide for a seat cushion assembly that is transportable.

It is another object of the present invention to provide for a seat cushion assembly that is inexpensive to fabricate and durable in operation.

BRIEF DESCRIPTION OF THE DRAWINGS

Similar reference numerals refer to similar parts throughout the several views of the drawings.

DESCRIPTION OF THE PREFERRED EMBODIMENTS

Figure 1:
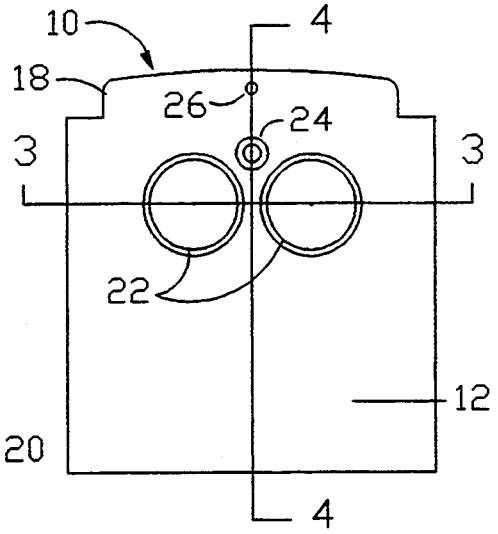
FIG. 1 is a top planar view of the base of the seat cushion assembly of the present invention.
Figure 2:
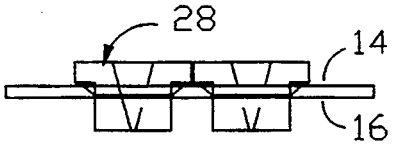
FIG. 2 is a side view of the seat cushion assembly of the present invention.
Figure 3:
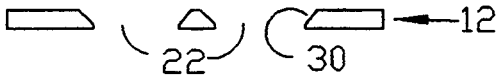
FIG. 3 is a cross-sectional view of the base of the seat cushion assembly taken on line 3—3 of FIG. 1.
Figure 4:
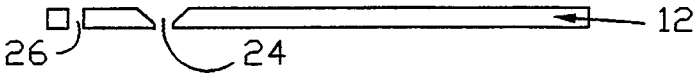
FIG. 4 is a cross-sectional view of the base of the seat cushion assembly taken on line 4—4 of FIG. 1.
Figure 5A:
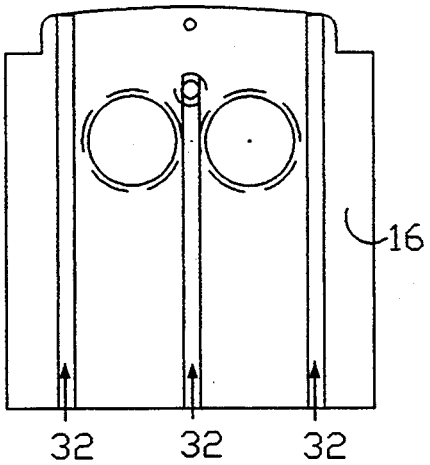
FIG. 5*a* is a bottom planar view of the seat cushion assembly of the present invention having a plurality of shim spacers attached in a first configuration.
Figure 5B:
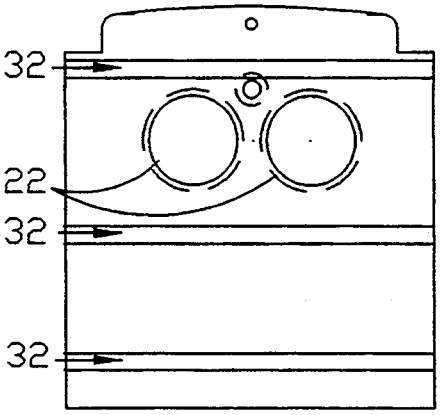
FIG. 5*b* is a bottom planar view of the seat cushion assembly of the present invention having a plurality of shim spacers attached in a second configuration.

FIGS. 1–6 illustrate the various views of the seat cushion assembly of the present invention. As illustrated, the seat cushion assembly 10 consist of a base 12. The base is made of a rigid and sturdy material, such as, but not limited to, wood or plastic. The base further comprises a top surface 14 and a bottom surface 16. Additionally, the base includes an upper section 18 and a lower section 20.

It is noted that the shape of the seat is deemed to be a matter of design choice. The configuration which is illustrated in these figures is ideal for use in a wheel chair. The notches located at the upper section are used to accommodate the framework of a wheelchair.

Located at the upper section 18 of the base 12 is a pair of openings 22 or a first opening and second opening. A third opening 24 is provided between and above the pair of openings. The pair of openings receive a pair of cushion inserts 28. The inserts, which are made from a soft material, are attachable into and removable from each opening. An example of a cushion insert that can be utilized with the seat cushion assembly is illustrated and discussed in further detail in FIG. 6.

As shown, the openings each have a circular shape. It is noted however that other shapes, such as elliptic, can be utilized.

The pair of openings or the first and second openings are tapered at an angle of approximately 60 degrees. These openings (first and second) receive the cushion inserts.

The first and second openings, along with the cushion inserts, receive the pelvic area (i.e. ischial tuberosities) of the individual who is utilizing the seat assembly. The cushion insert provides relief for the pelvic area by virtue of its soft characteristic while the tapering within the first and second openings aid in providing for an even pressure and weight distribution within the first and second openings.

The third opening (see FIG. 4) extends from the top surface to the bottom surface of the base. The diameter of the third opening decreases from the top surface of the base to the bottom surface of the base. This third opening receives the coccyx of the user.

A fourth opening 26 may be located above the third opening. This opening provides for a means of hanging and storing the seat assembly when not in use.

Attached to the bottom surface of the seat is a plurality of shim spacers 32. The plurality of shim spacers act as a height adjusting means and will provide for the seat assembly to be raised to a desired elevation. These shim spacers can be attached to the base in a vertical (FIG. 5*a*) or horizontal (FIG. 5*b*) configuration. Further, these shim spacers 32 can be permanently attached to the bottom surface of the base or can be attachable to or removable from the base. Cooperating hook and loop material (VELCRO) 34 provide for the shim spacers to be attachable to and removable from the bottom surface of the base.

It is noted that if the shim spacers are attached in a horizontal configuration, then the shim spacer which is located at the upper section of the base will have a height which is greater than the other shim spacers. This will provide for the seat assembly of the present invention to have a slight tilt forward, which is beneficial and comfortable for individuals who are in a sitting position.

Figure 6:
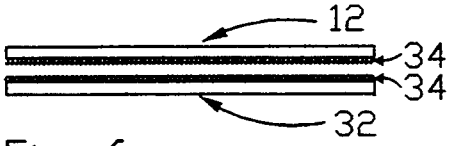
FIG. 6 is a side view of the shim spacers prior to attachment to the base.
Figure 7:
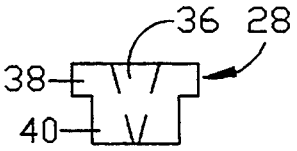
FIG. 7 is a side view of the cushion insert used in the present invention.

A cushion insert that is received in the first or second opening is illustrated in FIG. 7. As seen in FIG. 6, the cushion insert 28 consists of a top area 38 and a bottom area 40. The top area has a diameter which is larger that the bottom area and also larger that the diameter of the first or second opening. The bottom area is received in the openings.

The diameter of the bottom area of the cushion is larger than the diameter of the first or second opening. This cushion design and configuration will permit the cushion to be maintained, by friction, within the first or second opening since the cushion inserts are fabricated from a pliable material. In order to insert the cushion into the first or second opening, an individual applies a force (i.e. squeezing) to the bottom area. This will cause the bottom area to compress and decrease in size, thus allowing for the cushion to be inserted into the first or second opening. Once the cushion is in the desired position on the base and in the opening, it is released. This causes the bottom area to return to its original shape while providing for the encompassing side wall of the opening to contain the cushion in a secured position.

Centrally located on the cushion insert and extending from the top area to the bottom area is an aperture 36 (illustrated in outline). This aperture assists in pressure relief in the gluteal area as well as proving for the ventilation of air. It is noted that this aperture is optional.

The cushions can be fabricated from a variety of materials such as, but not limited to, foam and water, gel, or air filled cushions. Cushions made of foam, air, water, or gel are commonly known for their properties of providing soft contact to the specified area (i.e. pelvic) as well as for reducing the pressure in that specified area. By changing the cushion inserts, the seat has a different compression resistance range. Interchanging the cushion inserts renders a seat that is tailored to an individual's needs.

A seat pad (not illustrated) is located on the top surface of the base as well as the top area of the cushion. The seat pad is preferably the same shape as the base.

The components of the seat assembly of the present invention can be utilized individually or can be used in combination with the other components, depending on the needs of the individual. For example, the base can be used alone in a wheelchair that has a seat which is slightly sagging. The openings on the base will provide for an adequate amount of pressure relief in the pelvic area. The base, in combination with the attachable shim spacers, can be used with new wheel chairs (non-sagging seat), office chair, etc. The combination of the shim spacers to the base will provide for an elevation of the seat of the present invention. This will enable for the pelvic area of the user not to come into contact with the surface of the chair, thereby alleviating pressure to that area.

The cushions, made of foam or filled with gel, water or air (illustrated in FIG. 7), can be inserted into the openings. The use of the cushion within the openings of the base provides for a seat that will permit an even distribution of pressure in the gluteal region, thereby alleviating any problems, such as discomfort, pressure sores, pressure ulcers, and hemorrhoids, that are associated with long term sedentary positions (i.e. patients in wheelchairs).

For additional padding, a seat pad may be added on the cushion inserts.

While the invention has been particularly shown and described with reference to an embodiment thereof, it will be understood by those skilled in the art that various changes in form and detail may be made without departing from the spirit and scope of the invention.

I claim:

1. A seat cushion assembly comprising:

a base;

said base has a top surface, a bottom surface, a first end and a second end;

a first opening and a second opening extends through said first end of said base;

said first opening and said second opening receive a pelvic area of a user;

said first opening and said second opening are identical in size and design; and said first opening and said second opening are tapered and extend downwardly from said top surface and decreases in size to said bottom surface;

a third opening is centrally located above said first opening and said second opening and said third opening receives a coccyx of said user; and said third opening is smaller than said first opening or said second opening.

2. A seat cushion assembly as in claim 1 wherein a first cushion insert is received in said first opening and a second cushion insert is received in said second opening.

3. A seat cushion assembly as in claim 2 wherein said first cushion insert and said second cushion insert each have a top and a bottom said first opening has a first diameter;

said second opening has a second diameter;

said top of said first insert has a third diameter;

said top of said second insert has a fourth diameter;

said third diameter is larger than said first diameter;

said fourth diameter is larger than said second diameter;

said bottom of said first cushion is received in said first opening; and said bottom of said second cushion is received in said second opening.

4. A seat cushion assembly as in 3 wherein a first aperture is located in said first cushion insert;

a second aperture is located in said second cushion insert;

said first aperture extends from said top to said bottom of said first cushion insert; and said second aperture extends from said top to said bottom of said second cushion insert.

5. A seat cushion assembly as in claim 4 wherein said first aperture is tapered and decreases in size from said top to said bottom of said first cushion insert; and said second aperture is tapered and decreases in size from said top to said bottom of said second cushion insert.

6. A seat cushion assembly as in claim 5 wherein a seat pad is located on said top of said first cushion insert and said top of said second cushion insert.

7. A seat cushion assembly as in claim 6 wherein said first cushion insert and said second cushion insert are fabricated from foam.

8. A seat cushion assembly as in claim 6 wherein said first cushion insert and said second cushion insert are fabricated from water, gel, or air filled cushions.

9. A seat cushion assembly as in claim 1 wherein a pad is located on said top surface of said base.

10. A seat cushion assembly comprising:

a base;

said base has a top surface, a bottom surface, a first end and a second end;

a first opening and a second opening extends through said first end of said base;

said first opening and said second opening receive a pelvic area of a user;

said first opening and said second opening are identical in size and design;

said first opening and said second opening are tapered and extend downwardly from said top surface and decreases in size to said bottom surface;

a plurality of shim spacers are attachable to and detachable from said bottom surface by an attachment means; and said attachment means is a hook and loop material.

11. A seat cushion assembly as in claim 10 wherein a first cushion insert is received in said first opening and a second cushion insert is received in said second opening and said first cushion insert and said second cushion insert each have a top and a bottom;

said first opening has a first diameter and said second opening has a second diameter;

said top of said first insert has a third diameter;

said top of said second insert has a fourth diameter;

said bottom of said first cushion insert has a fifth diameter;

said bottom of said second cushion insert has a sixth diameter;

said fifth diameter is larger than said first diameter and smaller than said third diameter;

said sixth diameter is larger than said second diameter and smaller than said fourth diameter; and said first cushion insert is maintained in said first opening by friction and said second cushion insert is maintained in said second opening by friction.

12. A seat cushion assembly comprising:

a base;

said base has a top surface, a bottom surface, a first end and a second end;

a first opening and a second opening extends through said first end of said base;

said first opening and said second opening receive a pelvic area of a user;

said first opening and said second opening are identical in size and design; and said first opening and said second opening are tapered and extend downwardly from said top surface and decreases in size to said bottom; and said base is made from a rigid material.

13. A seat cushion assembly as in claim 12 wherein a plurality of shim spacers are secured to said bottom surface of said base.

14. A seat cushion assembly as in claim 12 wherein a first cushion insert is received in said first opening and a second cushion insert is received in said second opening.

15. A seat cushion assembly as in claim 14 wherein said first cushion inset and said second cushion inset each have a top and a bottom;

said first opening has a first diameter;

said second opening has a second diameter;

said top of said first insert has a third diameter;

said top of said second insert has a fourth diameter;

said third diameter is larger than said first diameter;

said fourth diameter is larger than said second diameter;

said bottom of said first cushion is received in said first opening; and said bottom of said second cushion is received in said second opening.

16. A seat cushion assembly as in claim 12 wherein a third opening is centrally located above said first opening and said second opening;

said third opening receives a coccyx of said user; and said third opening is smaller than said first opening or said second opening.

17. A seat cushion assembly as in claim 16 wherein a first cushion insert is received in said first opening and a second cushion insert is received in said second opening.

18. A seat cushion assembly as in claim 15 wherein a first aperture is located in said first cushion insert;

a second aperture is located in said second cushion insert;

said first aperture extends from said top to said bottom of said first cushion inset; and said second aperture extends from said top to said bottom of said second cushion insert.

19. A seat cushion assembly as in claim 16 wherein a fourth opening is located above said third opening for providing a means for hanging said seat cushion assembly.

* * * * *